US009995146B2

(12) United States Patent
Benson et al.

(10) Patent No.: US 9,995,146 B2
(45) Date of Patent: Jun. 12, 2018

(54) TURBINE AIRFOIL TURBULATOR ARRANGEMENT

(71) Applicant: General Electric Company, Schenectady, NY (US)

(72) Inventors: Adebukola Oluwaseun Benson, Simpsonville, SC (US); Nicholas Alvin Hogberg, Greenville, SC (US); Gary Michael Itzel, Simpsonville, SC (US); Mitchell Allan Merrill, Taylors, SC (US); Xiuzhang James Zhang, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 380 days.

(21) Appl. No.: 14/699,607

(22) Filed: Apr. 29, 2015

(65) Prior Publication Data

US 2016/0319671 A1 Nov. 3, 2016

(51) Int. Cl.
*F01D 5/18* (2006.01)

(52) U.S. Cl.
CPC ..... *F01D 5/18* (2013.01); *F01D 5/187* (2013.01); *F05D 2240/127* (2013.01); *F05D 2260/2212* (2013.01); *F05D 2260/22141* (2013.01)

(58) Field of Classification Search
CPC ..... F01D 5/18; F01D 5/187; F05D 2240/127; F05D 2260/2212; F05D 2260/22141
See application file for complete search history.

(56) References Cited

U.S. PATENT DOCUMENTS 5,681,144 A 10/1997 Spring et al.
5,695,320 A 12/1997 Kercher
(Continued)

FOREIGN PATENT DOCUMENTS

DE 103 16 906 A1 12/2003
EP 1 319 803 A2 6/2003
WO 01/31170 A1 5/2001

OTHER PUBLICATIONS

Ranade, Isheeta, et al.; Development of Novel Internal Cooling Geometry for Gas Turbine Blades; AIAA SciTech; 53rd AIAA Aerospace Sciences Meeting; Jan. 5-9, 2015; 12 pgs.
(Continued)

*Primary Examiner* — Dwayne J White
*Assistant Examiner* — Justin A Pruitt
(74) *Attorney, Agent, or Firm* — Ernest G. Cusick; Frank A. Landgraff

(57) ABSTRACT

A turbine airfoil includes a leading edge and a trailing edge. Also included is a cooling channel extending in a radial direction and tapering inwardly toward the trailing edge, the cooling channel at least partially defined by a pressure side face and a suction side face. Further included is a first plurality of turbulators protruding from one of the pressure side face and the suction side face to define a first height, the first plurality of turbulators extending toward the trailing edge of the turbine airfoil and spaced radially from each other. Yet further included is a second plurality of turbulators protruding from one of the pressure side face and the suction side face to define a second height that is less than the first height, the second plurality of turbulators extending toward the trailing edge of the turbine airfoil and spaced radially from each other.

20 Claims, 5 Drawing Sheets

(56) References Cited

U.S. PATENT DOCUMENTS

| | | | | |
|---|---|---|---|---|
| 5,700,132 | A * | 12/1997 | Lampes | F01D 5/187 415/115 |
| 5,738,493 | A | 4/1998 | Lee et al. | |
| 7,637,720 | B1 | 12/2009 | Liang | |
| 8,840,363 | B2 | 9/2014 | Lee | |
| 2006/0051208 | A1* | 3/2006 | Lee | F01D 5/187 416/97 R |
| 2012/0177503 | A1* | 7/2012 | Lee | F01D 5/187 416/96 R |
| 2013/0236330 | A1* | 9/2013 | Lee | F01D 5/182 416/97 R |

OTHER PUBLICATIONS

Naik, S. et al., "Impact of Turbulator Design on the Heat Transfer in a High Aspect Ratio Passage of a Turbine Blade," ASME Turbo Expo 2014: Turbine Technical Conference and Exposition, vol. 5A: Heat Transfer, Düsseldorf, Germany, Jun. 16-20, 2014, Copyright © 2014 by Alstom Technologie AG, pp. 1-13.

Extended European Search Report and Opinion issued in connection with corresponding EP Application No. 16167654.9 dated Aug. 30, 2016.

* cited by examiner

TURBINE AIRFOIL TURBULATOR ARRANGEMENT

BACKGROUND

The subject matter disclosed herein relates to gas turbine engines and, more particularly, to turbine airfoils having turbulators arrangements therein.

In turbine engines, such as gas turbine engines or steam turbine engines, fluids at relatively high temperatures contact blades that are configured to extract mechanical energy from the fluids to thereby facilitate a production of power and/or electricity. While this process may be highly efficient for a given period, over an extended time, the high temperature fluids tend to cause damage that can degrade performance and increase operating costs.

Accordingly, it is often necessary and advisable to cool the blades in order to at least prevent or delay premature failures. This can be accomplished by delivering relatively cool compressed air to the blades to be cooled. In many traditional gas turbines, in particular, this compressed air enters the bottom of each of the blades to be cooled and flows through one or more machined passages to cool the blade through a combination of convection and conduction. The passages may include features that enhance heat transfer to assist in cooling the passages, however some arrangements of these features block the cooling air flow to an undesirable extent. Therefore, balancing between blocking the cooling air and obtaining desirable heat transfer properties from the features poses challenges to turbine airfoil manufacturers and operators.

BRIEF DESCRIPTION

According to one embodiment, a turbine airfoil includes a leading edge and a trailing edge. Also included is a cooling channel extending in a radial direction and tapering inwardly as the cooling channel extends toward the trailing edge, the cooling channel at least partially defined by a pressure side face and a suction side face. Further included is a first plurality of turbulators protruding from one of the pressure side face and the suction side face to define a first height, the first plurality of turbulators extending toward the trailing edge of the turbine airfoil and spaced radially from each other. Yet further included is a second plurality of turbulators protruding from one of the pressure side face and the suction side face to define a second height that is less than the first height, the second plurality of turbulators extending toward the trailing edge of the turbine airfoil and spaced radially from each other.

According to another embodiment, a gas turbine engine includes a compressor section, a combustor section, and a turbine section having a turbine airfoil. The turbine airfoil includes a leading edge and a trailing edge. The turbine airfoil also includes a cooling channel extending in a radial direction and tapering inwardly as the cooling channel extends toward the trailing edge, the cooling channel at least partially defined by a pressure side face and a suction side face. The turbine airfoil further includes a first plurality of turbulators protruding from the suction side face to define a first height, the first plurality of turbulators extending toward the trailing edge of the turbine airfoil and spaced radially from each other. The turbine airfoil yet further includes a second plurality of turbulators protruding from the suction side face to define a second height that is less than the first height, the second plurality of turbulators extending toward the trailing edge of the turbine airfoil and spaced radially from each other. The turbine airfoil also includes a third plurality of turbulators protruding from the pressure side face to define a third height, the third plurality of turbulators extending toward the trailing edge of the turbine airfoil and spaced radially from each other. The turbine airfoil further includes a fourth plurality of turbulators protruding from the pressure side face to define a fourth height that is less than the third height, the fourth plurality of turbulators extending toward the trailing edge of the turbine airfoil and spaced radially from each other.

These and other advantages and features will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments described herein are apparent from the following detailed description taken in conjunction with the accompanying drawings in which:

The detailed description explains embodiments, together with advantages and features, by way of example with reference to the drawings.

DETAILED DESCRIPTION

Figure 1:
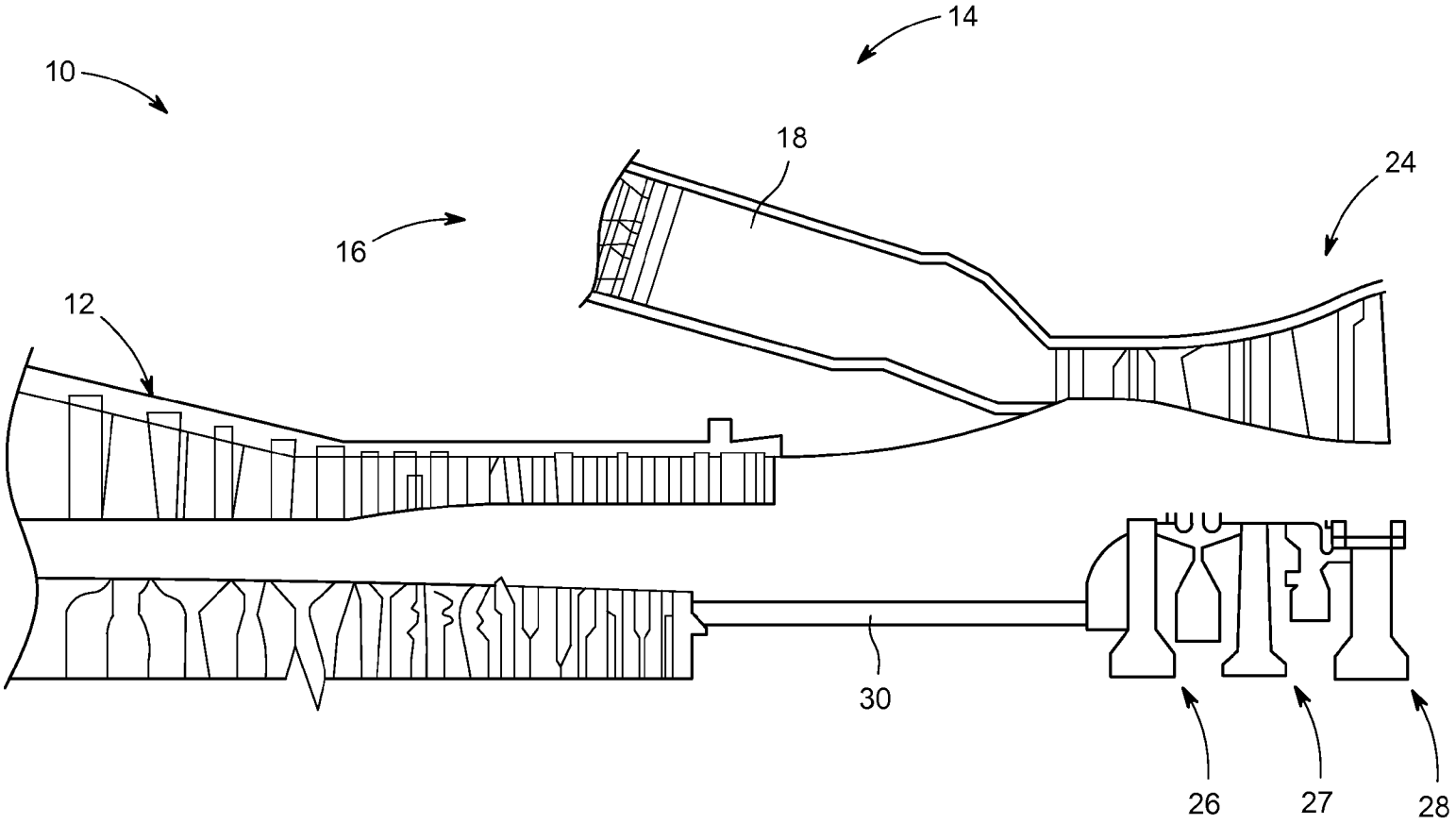
FIG. 1 is a schematic illustration of a gas turbine engine.

Referring to FIG. 1, a turbine system, such as a gas turbine engine 10, constructed in accordance with an exemplary embodiment is schematically illustrated. The gas turbine engine 10 includes a compressor section 12 and a plurality of combustor assemblies arranged in a can annular array, one of which is indicated at 14. The combustor assembly is configured to receive fuel from a fuel supply (not illustrated) and a compressed air from the compressor section 12. The fuel and compressed air are passed into a combustor chamber 18 and ignited to form a high temperature, high pressure combustion product or air stream that is used to drive a turbine 24. The turbine 24 includes a plurality of stages 26-28 that are operationally connected to the compressor 12 through a compressor/turbine shaft 30 (also referred to as a rotor). Although only three stages are illustrated, it is to be appreciated that more or less stages may be present.

In operation, air flows into the compressor 12 and is compressed into a high pressure gas. The high pressure gas is supplied to the combustor assembly 14 and mixed with fuel, for example natural gas, fuel oil, process gas and/or synthetic gas (syngas), in the combustor chamber 18. The fuel/air or combustible mixture ignites to form a high pressure, high temperature combustion gas stream, which is channeled to the turbine 24 and converted from thermal energy to mechanical, rotational energy.

Figure 2:
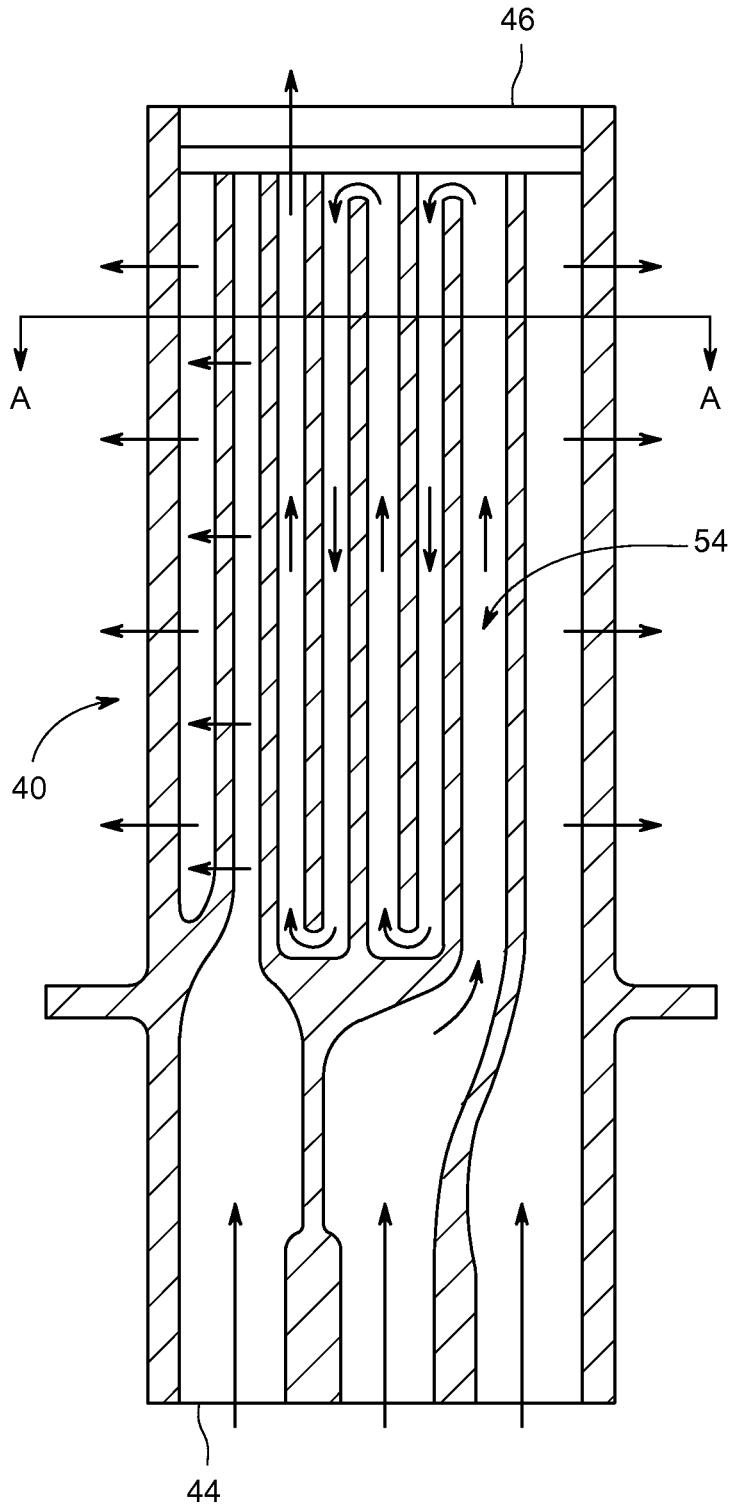
FIG. 2 is a cross-sectional view of a turbine airfoil.
Figure 3:
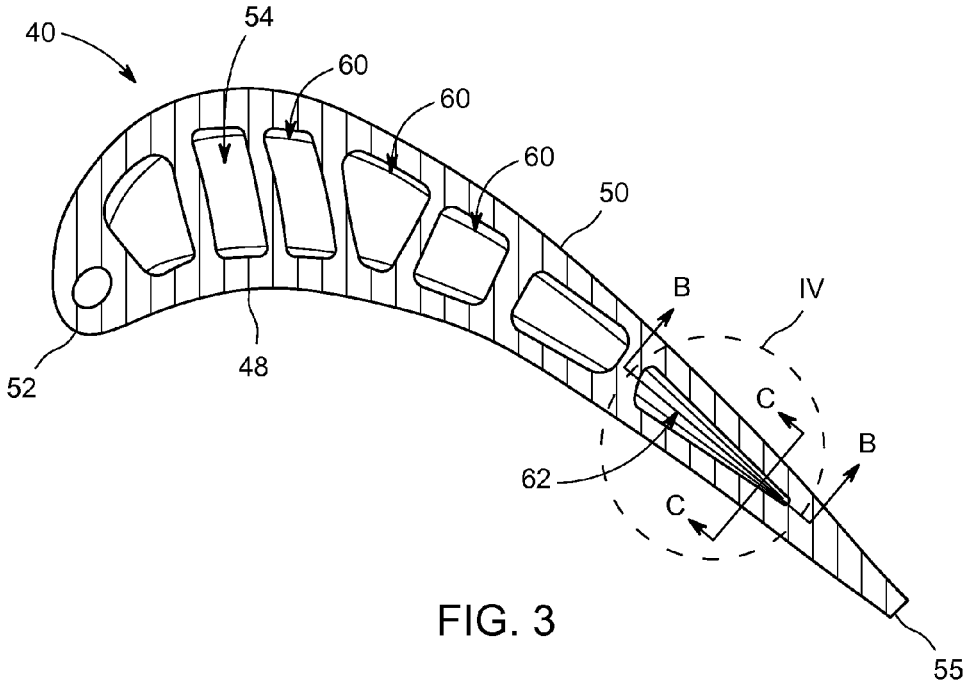
FIG. 3 is a cross-sectional view of the turbine airfoil taken along line A-A of FIG. 2.

Referring now to FIGS. 2 and 3, with continued reference to FIG. 1, a perspective view of a portion of a turbine airfoil 40 (also referred to as a "turbine bucket," "turbine blade airfoil" or the like) is illustrated. It is to be appreciated that the turbine airfoil 40 may be located in any stage of the turbine 24. In any event, the turbine airfoil 40 extends radially from a root portion 44 to a tip portion 46. The turbine airfoil 40 includes a pressure side wall 48 and a suction side wall 50, where the geometry of the turbine airfoil 40 is configured to provide rotational force for the turbine 24 as fluid flows over the turbine airfoil 40. As depicted, the suction side wall 50 is convex-shaped and the pressure side wall 48 is concave-shaped. Also included are a leading edge 52 and a trailing edge 55, which are joined by the pressure side wall 48 and the suction side wall 50. Although the following discussion primarily focuses on gas turbines, the concepts discussed are not limited to gas turbine engines and may be applied to any rotary machine employing turbine blades.

The pressure side wall 48 and the suction side wall 50 are spaced apart in the circumferential direction over the entire radial span of the turbine airfoil 40 to define at least one internal flow chamber or channel for channeling cooling air through the turbine airfoil 40 for the cooling thereof. In the illustrated embodiment, a plurality of cooling channels 54 is illustrated. In the illustrated embodiment, a portion of the cooling scheme comprises a serpentine flow path, but it is to be appreciated that alternative cooling channel configurations may be present. Regardless of the precise flow path, the cooling air is typically bled from the compressor section 12 in any conventional manner, routed to the plurality of cooling channels 54 and subsequently exhausted out one or more outlet holes that may be located at any suitable location on the turbine airfoil 40.

To assist with obtaining desirable heat transfer between the cooling air and the turbine airfoil 40, at least one of the plurality of cooling channels 54 includes one or more structural features 60 protruding from at least one wall that defines the cooling channel. While the structural features 60 enhance the heat transfer, a concern with impeding the cooling air is present. As shown in FIG. 3, less concern is associated with some of the plurality of cooling channels 54, such as those having larger cross-sectional areas that are primarily accommodated by wider portions of the turbine airfoil 40. However, as illustrated, this concern is more prevalent for cooling channels located toward the trailing edge 55 of the turbine airfoil 40.

Figure 4:
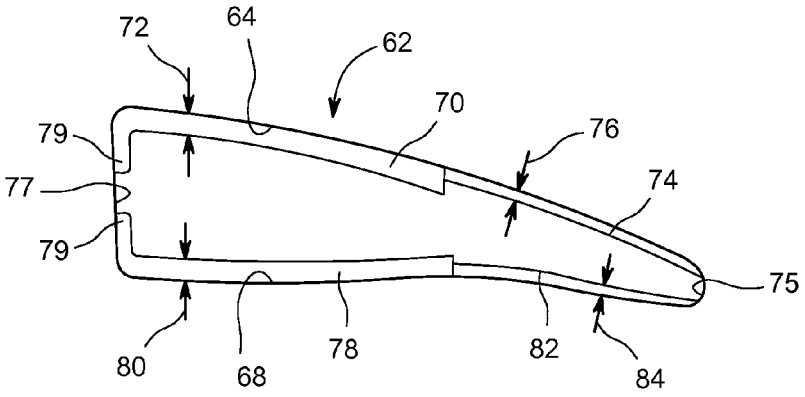
FIG. 4 is an enlarged view of section IV illustrating a cooling channel of the turbine airfoil.
Figure 6:
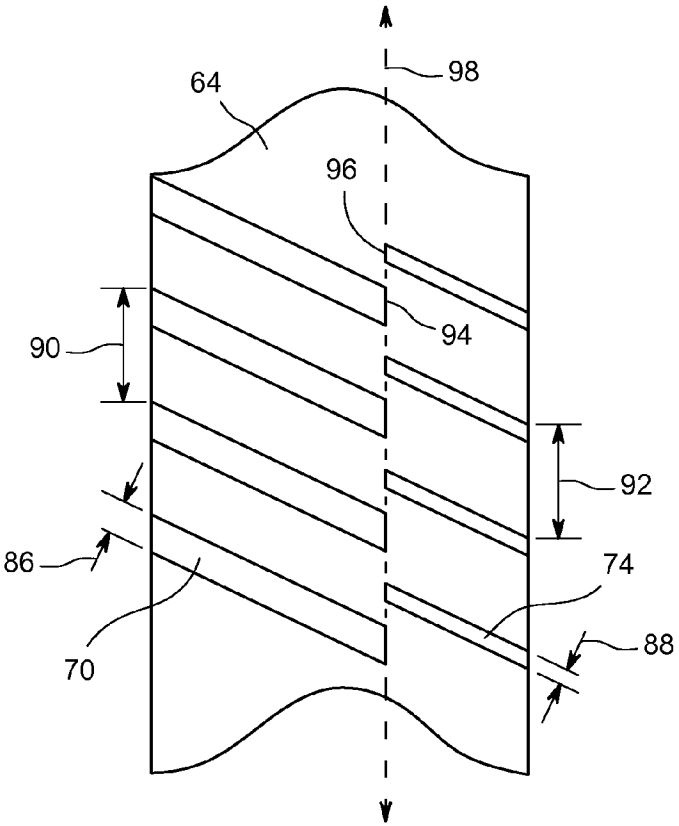
FIG. 6 is a cross-sectional view of the cooling channel taken along line B-B of FIG. 3 illustrating a turbulator arrangement according to a first embodiment.
Figure 5:
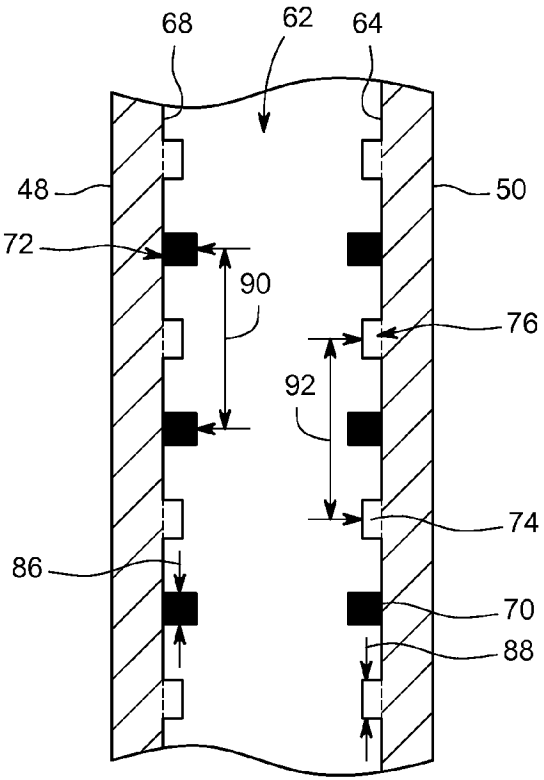
FIG. 5 is a cross-sectional view of the cooling channel taken along line C-C of FIG. 3.

Referring to FIGS. 4-6, a most rearward located cooling channel is illustrated in greater detail and referenced with numeral 62. For purposes of discussion, only the single rearward located cooling channel will be described in detail, but it is to be understood that other cooling channels of the turbine airfoil 40 may benefit from the embodiments of the turbulator arrangement that will be described in detail below.

The cooling channel 62 includes a suction side face 64 and a pressure side face 68 that, in combination, partially define the cooling channel 62. The suction side face 64 and the pressure side face 68 extend between a leading edge face 77 and a trailing edge face 75. As shown, the cooling channel 62 tapers inwardly as the cooling channel 62 extends toward the trailing edge 55 of the turbine airfoil 40 and more specifically toward the trailing edge face 75 of the cooling channel 62. As described above, the cooling channel 62 includes structural features 60 for heat transfer purposes. The embodiments of various arrangements of these features are described in detail herein and it will be understood that the embodiments address the inward tapering of the cooling channel 62 by maintaining efficient heat transfer and avoiding excessive blocking of the flow of cooling air therethrough.

A first plurality of turbulators 70 protrudes from the suction side face 64. Each of the first plurality of turbulators 70 extends from the suction side face 64 to a distance that defines a first height 72. Each of the first plurality of turbulators 70 is spaced from each other in a radial direction and extend in a longitudinal direction toward the trailing edge 55 of the turbine airfoil 40. The specific angle at which each of the first plurality of turbulators 70 are oriented may vary. For example, the first plurality of turbulators 70 may be oriented parallel to, perpendicular to, or at an angle to a main flow direction of the cooling air. In the illustrated embodiment, all of the turbulators are oriented at the same angle, but in some embodiments the turbulators are at different angles.

A second plurality of turbulators 74 protrudes from the suction side face 64. Each of the second plurality of turbulators 74 extends from the suction side face 64 to a distance that defines a second height 76. Each of the second plurality of turbulators 74 is spaced from each other in a radial direction and extends in a longitudinal direction toward the trailing edge 55 of the turbine airfoil 40. The specific angle at which each of the second plurality of turbulators 74 are oriented may vary. For example, the second plurality of turbulators 74 may be oriented parallel to, perpendicular to, or at an angle to a main flow direction of the cooling air. In the illustrated embodiment, all of the turbulators are oriented at the same angle, but in some embodiments the turbulators are at different angles.

To accommodate the tapering of the cooling channel 62, the second height 76 is less than the first height 72. In other words, the second plurality of turbulators 74 does not protrude as far away from the suction side face 64 as the first plurality of turbulators 70. This relative dimensioning avoids the excessive blocking of the cooling flow, as described above.

A third plurality of turbulators 78 protrudes from the pressure side face 68. Each of the third plurality of turbulators 78 extends from the pressure side face 68 to a distance that defines a third height 80. Each of the third plurality of turbulators 78 is spaced from each other in a radial direction and extend in a longitudinal direction toward the trailing edge 55 of the turbine airfoil 40. The specific angle at which each of the third plurality of turbulators 78 are oriented may vary. For example, the third plurality of turbulators 78 may be oriented parallel to, perpendicular to, or at an angle to a main flow direction of the cooling air. In the illustrated embodiment, all of the turbulators are oriented at the same angle, but in some embodiments the turbulators are at different angles.

A fourth plurality of turbulators 82 protrudes from the pressure side face 68. Each of the fourth plurality of turbulators 82 extends from the pressure side face 68 to a distance that defines a fourth height 84. Each of the fourth plurality of turbulators 82 is spaced from each other in a radial direction and extends in a longitudinal direction toward the trailing edge 55 of the turbine airfoil 40. The specific angle at which each of the fourth plurality of turbulators 82 are oriented may vary. For example, the fourth plurality of turbulators 82 may be oriented parallel to, perpendicular to, or at an angle to a main flow direction of the cooling air. In the illustrated embodiment, all of the turbulators are oriented at the same angle, but in some embodiments the turbulators are at different angles.

As described above in conjunction with the first and second plurality of turbulators, to accommodate the tapering of the cooling channel 62, the fourth height 84 is less than the third height 80. In other words, the fourth plurality of turbulators 82 does not protrude as far away from the pressure side face 68 as the third plurality of turbulators 78. This relative dimensioning avoids the excessive blocking of the cooling flow, as described above.

Although illustrated and described as having turbulator arrangements on both faces of the cooling channel 62, it is contemplated that a single face (suction side face 64 or pressure side face 68) of the cooling channel 62 includes the turbulators. Accordingly, although the first plurality of turbulators 70 and the second plurality of turbulators 74 are shown and described herein as being on the suction side face 64, one can readily appreciate that they may protrude from the pressure side face 68. Furthermore, although only two turbulator types are illustrated and described herein for each side face, some embodiments include more than two differently sized and/or spaced turbulator types. For embodiments having turbulator arrangements on both sides of the cooling channel 62, the respective arrangements may be symmetric or may vary in size, angular orientation, spacing and relative alignment between the turbulators. In addition to the turbulators on the suction side face 64 and the pressure side face 68, one or more turbulators may extend from the leading edge face 77 and/or the trailing edge face 75. In the illustrated embodiment of FIG. 4, turbulators 79 are included on the leading edge 77. It is to be appreciated that the turbulators 79 on the leading edge face 77 and/or the trailing edge face 75 may be dimensioned in the same or a different manner relative to any of the turbulators extending from the suction side wall 64 and the pressure side wall 68. In some embodiments, as shown, the turbulators 79 may simply be extensions of the turbulators from the suction side wall 64 and/or the pressure side wall 68. In such embodiments, the turbulators simply wrap around to form a turbulator on the leading edge face 77.

The heat transfer efficiency of the turbulators is partially dependent upon the relative sizing, angular orientation, spacing and relative alignment. The embodiments disclosed herein include arrangements that advantageously take these factors into account. In addition to the first height 72 and the second height 76 described above, each of the plurality of first turbulators 70 comprises a first thickness 86 and each of the plurality of second turbulators 74 comprises a second thickness 88. In addition to these dimensions, a dimension associated with the turbulator spacing impacts heat transfer efficiency. The spacing of the first plurality of turbulators 70, defined by a common respective point such as mid-point to mid-point, is referred to as a first pitch 90. The spacing of the second plurality of turbulators 74, defined by a common respective point such as mid-point to mid-point, is referred to as a second pitch 92. A first ratio is defined as the first pitch 90 divided by the first height 72 and a second ratio is defined as the second pitch 92 divided by the second height 76. In some embodiments, the ratios each are within a range of 7-12. It is to be understood that the first ratio and the second ratio may be about equal or different within the specified range of 7-12.

Figure 9:
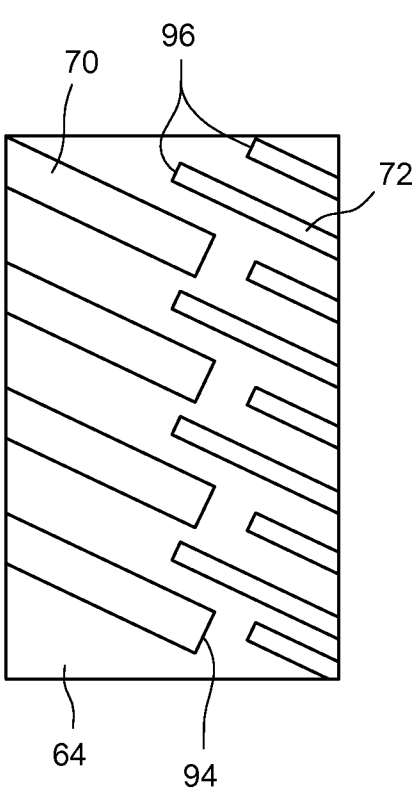
FIG. 9 is a cross-sectional view of the cooling channel taken along line B-B of FIG. 3 illustrating a turbulator arrangement according to a fourth embodiment.
Figure 8:
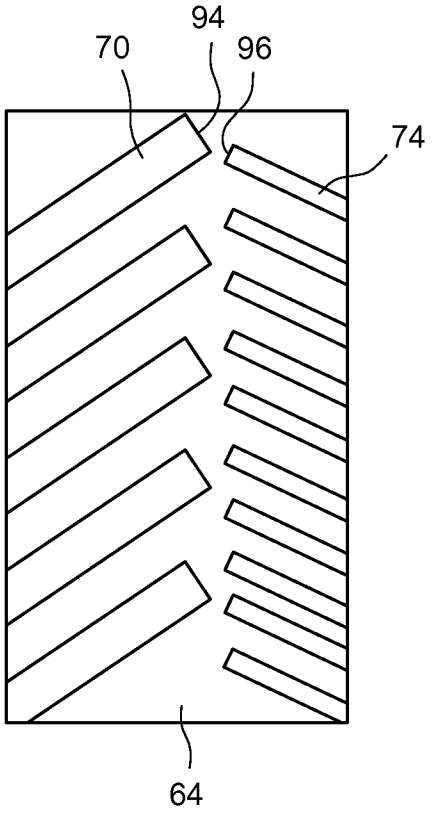
FIG. 8 is a cross-sectional view of the cooling channel taken along line B-B of FIG. 3 illustrating a turbulator arrangement according to a third embodiment.
Figure 7:
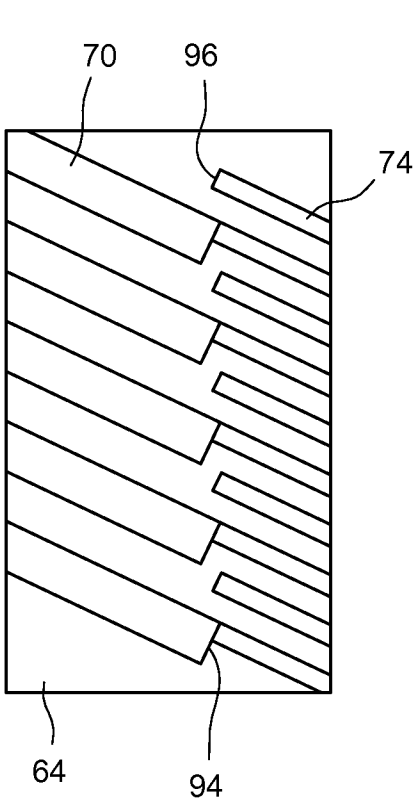
FIG. 7 is a cross-sectional view of the cooling channel taken along line B-B of FIG. 3 illustrating a turbulator arrangement according to a second embodiment.

As shown in FIGS. 6, 7 and 9, the first plurality of turbulators 70 and the second plurality of turbulators 74 are oriented at a same angle in some embodiments, while they may be oriented at distinct angles in other embodiments (FIG. 8). Additional variations relate to the termination point in a longitudinal direction of the first plurality of turbulators 70 relative to the second plurality of turbulators 74. In particular, a trailing end 94 of the first plurality of turbulators 70 extends to an extreme point and a leading end 96 of the second plurality of turbulators 74 extends to an extreme point. In one embodiment (FIG. 6), the trailing end 94 and the leading end 96 extend to a common plane 98. In another embodiment (FIG. 8), they are spaced from each other. In yet another embodiment (FIG. 9), they are disposed in an overlapping arrangement, such that at least one of the turbulators of one group protrudes into an overlapped arrangement with at least one of the turbulators of the other group.

In addition to the variations described above, multiple embodiments relating to the relative radial alignment of the first plurality of turbulators 70 and the second plurality of turbulators 74 are provided. In at least one embodiment, such as that illustrated in FIG. 6, the trailing end 94 of the first plurality of turbulators 70 are each radially misaligned with the leading end 96 of each of the second plurality of turbulators 74. Alternatively, the trailing end 94 and the leading end 96 may each be radially aligned such as that illustrated in FIG. 7. In yet another alternative, as illustrated in FIG. 9, a combination of radial alignment and misalignment may be provided.

Advantageously, the embodiments described herein maintain desirable heat transfer properties within the cooling channel 62, which has a high aspect ratio. The heat transfer enhancement is achieved, while also avoiding impeding the flow of cooling air within the cooling channel 62.

While the embodiments have been described in detail in connection with only a limited number of embodiments, it should be readily understood that the embodiments are not limited to such disclosed embodiments. Rather, the embodiments can be modified to incorporate any number of variations, alterations, substitutions or equivalent arrangements not heretofore described, but which are commensurate with the spirit and scope of the embodiments. Additionally, while various embodiments have been described, it is to be understood that aspects of the embodiments may include only some of the described embodiments. Accordingly, the embodiments are not to be seen as limited by the foregoing description, but are only limited by the scope of the appended claims.

What is claimed is:

1. A turbine airfoil comprising:

a leading edge;

a trailing edge;

a cooling channel extending in a radial direction from a root portion to a tip portion and tapering inwardly as the cooling channel extends toward the trailing edge, the cooling channel at least partially defined by a pressure side face and a suction side face;

a first plurality of turbulators disposed in the cooling channel and protruding from one of the pressure side face and the suction side face to define a first height, the first plurality of turbulators extending toward the trailing edge of the turbine airfoil and spaced radially from each other; and a second plurality of turbulators disposed in the cooling channel and protruding from one of the pressure side face and the suction side face to define a second height that is less than the first height, the second plurality of turbulators extending toward the trailing edge of the turbine airfoil and spaced radially from each other.

2. The turbine airfoil of claim 1, wherein a cooling air is routed through the cooling channel along a main flow direction, at least one of the first plurality of turbulators and the second plurality of turbulators oriented parallel to the main flow direction.

3. The turbine airfoil of claim 1, wherein a cooling air is routed through the cooling channel along a main flow direction, at least one of the first plurality of turbulators and the second plurality of turbulators oriented perpendicularly to the main flow direction.

4. The turbine airfoil of claim 1, wherein a cooling air is routed through the cooling channel along a main flow direction, at least one of the first plurality of turbulators and the second plurality of turbulators oriented at an angle to the main flow direction.

5. The turbine airfoil of claim 1, wherein the first plurality of turbulators are all oriented at a first angle and the second plurality of turbulators are all disposed at a second angle that is distinct from the first angle.

6. The turbine airfoil of claim 1, wherein the first plurality of turbulators and the second plurality of turbulators are all oriented at the same angle.

7. The turbine airfoil of claim 1, wherein each of the first plurality of turbulators include a trailing end and each of the second plurality of turbulators include a leading end, wherein the trailing end of each of the first plurality of turbulators and the leading end of each of the second plurality of turbulators are located within a common plane.

8. The turbine airfoil of claim 1, wherein each of the first plurality of turbulators include a trailing end and each of the second plurality of turbulators include a leading end, and where the trailing end and the leading end are located in an overlapping arrangement.

9. The turbine airfoil of claim 1, wherein the first plurality of turbulators are radially aligned with the second plurality of turbulators.

10. The turbine airfoil of claim 1, wherein the first plurality of turbulators are radially misaligned with the second plurality of turbulators to form a staggered arrangement.

11. The turbine airfoil of claim 1, wherein at least one of the first plurality of turbulators is radially aligned with one of the second plurality of turbulators and at least one of the first plurality of turbulators is radially misaligned with the second plurality of turbulators.

12. The turbine airfoil of claim 1, wherein each pair of adjacent turbulators of the first plurality of turbulators comprises a first pitch and each of the first plurality of turbulators includes a first height, each pair of adjacent turbulators of the second plurality of turbulators comprises a second pitch and each of the second plurality of turbulators includes a second height, wherein the second pitch is less than the first pitch and the second height is less than the first height.

13. The turbine airfoil of claim 12, further comprising a first ratio defined by the first pitch divided by the first height and a second ratio defined by the second pitch divided by the second height, wherein the first ratio and the second ratio are each within a range of 7-12.

14. The turbine airfoil of claim 1, wherein the first plurality of turbulators and the second plurality of turbulators protrude from the suction side face, the turbine airfoil further comprising:

a third plurality of turbulators disposed in the cooling channel and protruding from the pressure side face to define a third height, the third plurality of turbulators extending toward the trailing edge of the turbine airfoil and spaced radially from each other; and a fourth plurality of turbulators disposed in the cooling channel and protruding from the pressure side face to define a fourth height that is less than the third height, the fourth plurality of turbulators extending toward the trailing edge of the turbine airfoil and spaced radially from each other.

15. The turbine airfoil of claim 14, wherein the third plurality of turbulators are radially aligned with the first plurality of turbulators and the fourth plurality of turbulators are radially aligned with the second plurality of turbulators.

16. The turbine airfoil of claim 14, wherein the third plurality of turbulators are radially misaligned with the first plurality of turbulators and the fourth plurality of turbulators are radially misaligned with the second plurality of turbulators.

17. A gas turbine engine comprising:

a compressor section;

a combustor section; and a turbine section having a turbine airfoil comprising:

a leading edge;

a trailing edge;

a cooling channel extending in a radial direction from a root portion to a tip portion and tapering inwardly as the cooling channel extends toward the trailing edge, the cooling channel at least partially defined by a pressure side face and a suction side face;

a first plurality of turbulators disposed in the cooling channel and protruding from the suction side face to define a first height, the first plurality of turbulators extending toward the trailing edge of the turbine airfoil and spaced radially from each other;

a second plurality of turbulators disposed in the cooling channel and protruding from the suction side face to define a second height that is less than the first height, the second plurality of turbulators extending toward the trailing edge of the turbine airfoil and spaced radially from each other;

a third plurality of turbulators disposed in the cooling channel and protruding from the pressure side face to define a third height, the third plurality of turbulators extending toward the trailing edge of the turbine airfoil and spaced radially from each other; and a fourth plurality of turbulators disposed in the cooling channel and protruding from the pressure side face to define a fourth height that is less than the third height, the fourth plurality of turbulators extending toward the trailing edge of the turbine airfoil and spaced radially from each other.

18. The gas turbine engine of claim 17, wherein the first plurality of turbulators are oriented at a first angle and the second plurality of turbulators are disposed at a second angle that is distinct from the first angle.

19. The gas turbine engine of claim 17, wherein each of the first plurality of turbulators include a trailing end and the second plurality of turbulators include a leading end, the trailing end and the leading end spaced from each other.

20. The gas turbine engine of claim 17, wherein each pair of adjacent turbulators of the first plurality of turbulators comprises a first pitch and each of the first plurality of turbulators includes a first height, each pair of adjacent turbulators of the second plurality of turbulators comprises a second pitch and each of the second plurality of turbulators includes a second height, wherein the second pitch is less than the first pitch and the second height is less than the first height, wherein a first ratio is defined by the first pitch divided by the first height and a second ratio is defined by the second pitch divided by the second height, wherein the first ratio and the second ratio are each within a range of 7-12.

* * * * *